US009911256B1

(12) United States Patent
Kingsbury et al.

(10) Patent No.: US 9,911,256 B1
(45) Date of Patent: Mar. 6, 2018

(54) RESTRICTING ACCESS TO A BUILDING

(71) Applicant: Lenovo (Singapore) Pte. Ltd., Singapore (SG)

(72) Inventors: Timothy Winthrop Kingsbury, Cary, NC (US); Justin Tyler Dubs, Raleigh, NC (US); Christopher Aaron Whitesock, Clayton, NC (US); David Rivera, Raleigh, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 15/243,232

(22) Filed: Aug. 22, 2016

(51) Int. Cl.
*G07C 9/00* (2006.01)

(52) U.S. Cl.
CPC ..... *G07C 9/00071* (2013.01)

(58) Field of Classification Search
CPC ..... G07C 9/00071
See application file for complete search history.

(56) References Cited

U.S. PATENT DOCUMENTS

2005/0149742 A1* 7/2005 Weis ..... G07C 9/00563 713/186
2011/0205016 A1* 8/2011 Al-Azem ..... H04L 63/0861 340/5.52
2015/0089240 A1* 3/2015 Itkis ..... H04L 63/0861 713/186
2016/0260271 A1* 9/2016 Belhadia ..... G06F 21/32

* cited by examiner

*Primary Examiner* — Leon Flores
(74) *Attorney, Agent, or Firm* — Ference & Associates LLC

(57) ABSTRACT

One embodiment provides a method, including: obtaining, using a sensor, biometric data of a user; determining, using a processor, that the biometric data of the user does not match biometric data of a known user; and securing, based on the biometric data of the user, an area within a building. Other aspects are described and claimed.

18 Claims, 3 Drawing Sheets

RESTRICTING ACCESS TO A BUILDING

BACKGROUND

It is desirable to give guests access to a building, e.g., a home, while also restricting the guests from accessing specific areas. This can be important for privacy reasons as well as for safety issues.

It is convenient to keep a building such as a house in a fully open and accessible state for the benefit of the owners when the owners are alone. Requirements for securing parts of the building, however, can quickly change if unexpected guests arrive or if others are present.

BRIEF SUMMARY

In summary, one aspect provides a method, comprising: obtaining, using a sensor, biometric data of a user; determining, using a processor, that the biometric data of the user does not match biometric data of a known user; and securing, based on the biometric data of the user, an area within a building.

Another aspect provides a device, comprising: a biometric sensor; a processor operatively coupled to the biometric sensor; and a memory that stores instructions executable by the processor to: obtain biometric data of a user; determine that the biometric data of the user does not match biometric data of a known user; and secure, based on the biometric data of the user, an area within a building.

A further aspect provides a program product, comprising: a storage device that stores code, the code being executable by a processor and comprising: code that obtains, using a sensor, biometric data of a user; code that determines, using a processor, that the biometric data of the user does not match biometric data of a known user; and code that secures, based on the biometric data of the user, an area within a building.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1:
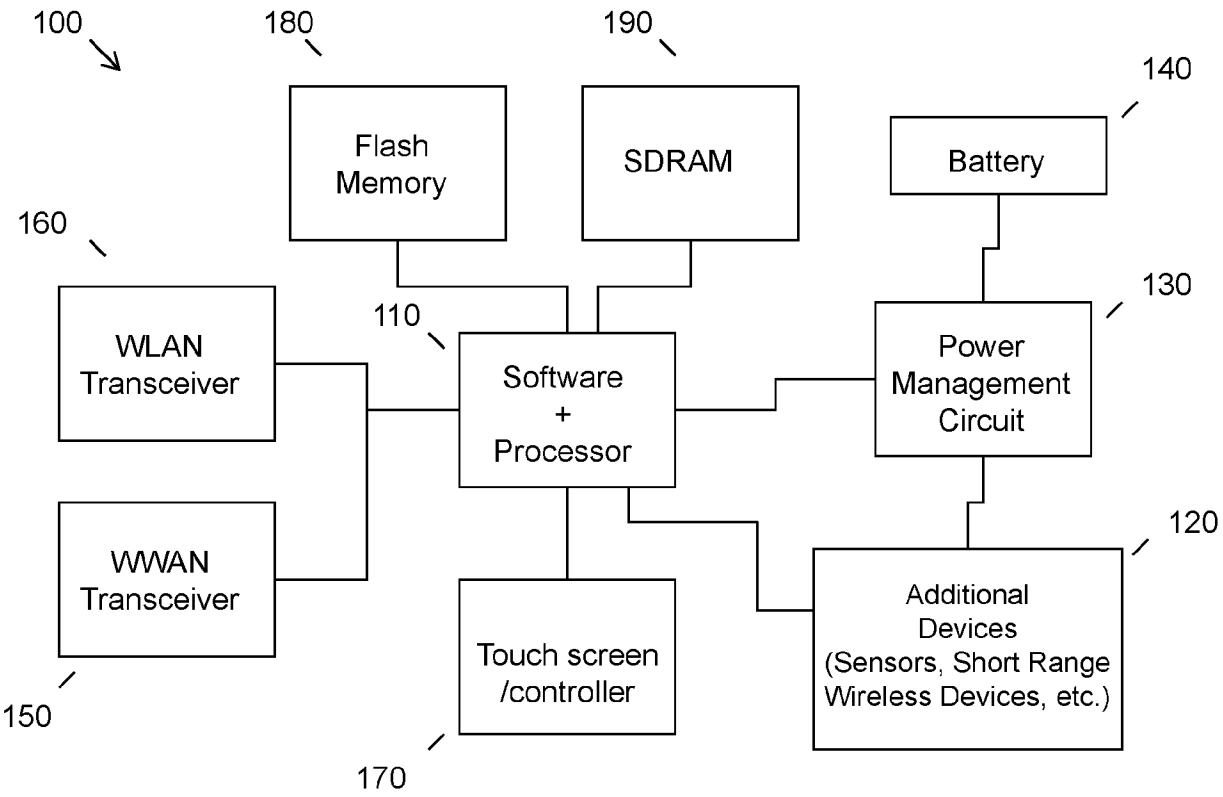
FIG. 1 illustrates an example of information handling device circuitry.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

Currently, no automated solutions exist for securing parts of a building such as a home, an office building, a restaurant, etc. Therefore, the owner or caretaker has to go through the building and close and lock doors or cabinets as needed.

An embodiment operates by using biometrics to detect the presence of particular individual(s), e.g., home owners versus house guests, and thereafter automatically implementing security settings based on the biometrics data. Techniques for recognizing individual(s) within the building include a variety of biometric identification techniques such as facial recognition and/or voice recognition. In an embodiment, biometric components are deployed at predetermined locations, e.g., at entrances to the building, within particular rooms, on or viewing certain areas of the building (e.g., particular rooms, particular cabinets or other objects, etc.).

If guests are detected, an embodiment automatically secures area(s) of the building, e.g., to implement a restricted state. When this occurs, a variety of changes take place, for example, bedroom doors are automatically closed and locked, specific wings or areas of the building are closed and locked, cabinets are locked, electronic devices are locked or set to a guest mode of operation, etc.

The specific actions that occur are configurable, e.g., by the owner making selections using a user interface. Areas that are restricted may have a security feature added, e.g., an area may require additional verification in order to be unlocked. According to a policy, which again may be configured, e.g., by the owner, the securing may be reversed, e.g., when the guests are detected as leaving, then the building will revert to its fully accessible state.

The illustrated example embodiments will be best understood by reference to the figures. The following description is intended only by way of example, and simply illustrates certain example embodiments.

While various other circuits, circuitry or components may be utilized in information handling devices, with regard to mobile device circuitry 100, an example illustrated in FIG. 1 includes a system on a chip design found for example in many smaller or mobile computing platforms. Software and processor(s) are combined in a single chip 110. Processors comprise internal arithmetic units, registers, cache memory, busses, I/O ports, etc., as is well known in the art. Internal busses and the like depend on different vendors, but essentially all the peripheral devices (120) may attach to a single chip 110. The circuitry 100 combines the processor, memory control, and I/O controller hub all into a single chip 110.

Also, systems 100 of this type do not typically use SATA or PCI or LPC. Common interfaces, for example, include SDIO and I2C.

There are power management chip(s) 130, e.g., a battery management unit, BMU, which manage power as supplied, for example, via a rechargeable battery 140, which may be recharged by a connection to a power source (not shown). In at least one design, a single chip, such as 110, is used to supply BIOS like functionality and DRAM memory.

System 100 typically includes one or more of a WWAN transceiver 150 and a WLAN transceiver 160 for connecting to various networks, such as telecommunications networks and wireless Internet devices, e.g., access points. Additionally, devices 120 are commonly included and may be added based on a particular design. For example, additional devices 120 may include a sensor or sensor(s), for example an optical sensor such as a camera and/or an infrared sensor, a fingerprint reader, a microphone, etc., as well as short range wireless devices, e.g., BLUETOOTH wireless communication devices. System 100 often includes a touch screen 170 for data input and display/rendering. System 100 also typically includes various memory devices, for example flash memory 180 and SDRAM 190.

Figure 2:
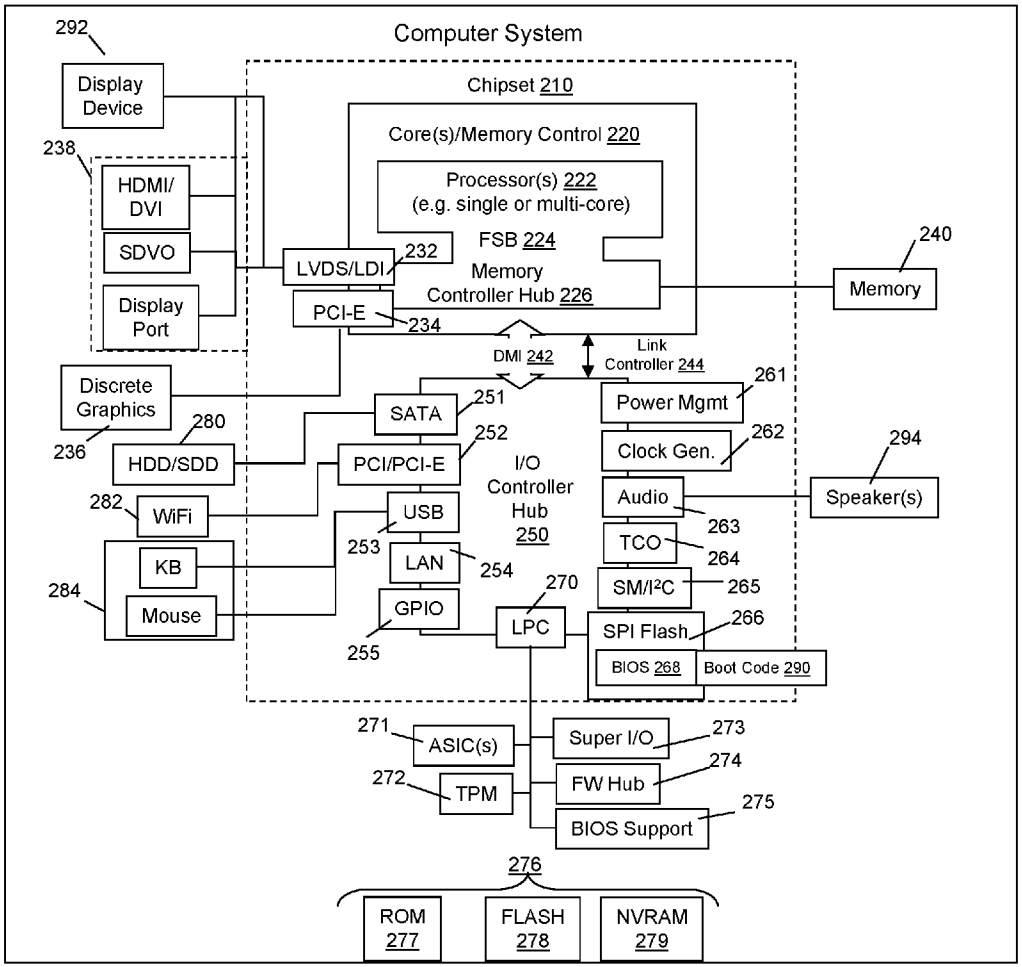
FIG. 2 illustrates another example of information handling device circuitry.

FIG. 2 depicts a block diagram of another example of information handling device circuits, circuitry or components. The example depicted in FIG. 2 may correspond to computing systems such as the THINKPAD series of personal computers sold by Lenovo (US) Inc. of Morrisville, N.C., or other devices. As is apparent from the description herein, embodiments may include other features or only some of the features of the example illustrated in FIG. 2.

The example of FIG. 2 includes a so-called chipset 210 (a group of integrated circuits, or chips, that work together, chipsets) with an architecture that may vary depending on manufacturer (for example, INTEL, AMD, ARM, etc.). INTEL is a registered trademark of Intel Corporation in the United States and other countries. AMD is a registered trademark of Advanced Micro Devices, Inc. in the United States and other countries. ARM is an unregistered trademark of ARM Holdings plc in the United States and other countries. The architecture of the chipset 210 includes a core and memory control group 220 and an I/O controller hub 250 that exchanges information (for example, data, signals, commands, etc.) via a direct management interface (DMI) 242 or a link controller 244. In FIG. 2, the DMI 242 is a chip-to-chip interface (sometimes referred to as being a link between a "northbridge" and a "southbridge"). The core and memory control group 220 include one or more processors 222 (for example, single or multi-core) and a memory controller hub 226 that exchange information via a front side bus (FSB) 224; noting that components of the group 220 may be integrated in a chip that supplants the conventional "northbridge" style architecture. One or more processors 222 comprise internal arithmetic units, registers, cache memory, busses, I/O ports, etc., as is well known in the art.

In FIG. 2, the memory controller hub 226 interfaces with memory 240 (for example, to provide support for a type of RAM that may be referred to as "system memory" or "memory"). The memory controller hub 226 further includes a low voltage differential signaling (LVDS) interface 232 for a display device 292 (for example, a CRT, a flat panel, touch screen, etc.). A block 238 includes some technologies that may be supported via the LVDS interface 232 (for example, serial digital video, HDMI/DVI, display port). The memory controller hub 226 also includes a PCI-express interface (PCI-E) 234 that may support discrete graphics 236.

In FIG. 2, the I/O hub controller 250 includes a SATA interface 251 (for example, for HDDs, SDDs, etc., 280), a PCI-E interface 252 (for example, for wireless connections 282), a USB interface 253 (for example, for devices 284 such as a digitizer, keyboard, mice, cameras, phones, microphones, storage, biometric data capture device, other connected devices, etc.), a network interface 254 (for example, LAN), a GPIO interface 255, a LPC interface 270 (for ASICs 271, a TPM 272, a super I/O 273, a firmware hub 274, BIOS support 275 as well as various types of memory 276 such as ROM 277, Flash 278, and NVRAM 279), a power management interface 261, a clock generator interface 262, an audio interface 263 (for example, for speakers 294), a TCO interface 264, a system management bus interface 265, and SPI Flash 266, which can include BIOS 268 and boot code 290. The I/O hub controller 250 may include gigabit Ethernet support.

The system, upon power on, may be configured to execute boot code 290 for the BIOS 268, as stored within the SPI Flash 266, and thereafter processes data under the control of one or more operating systems and application software (for example, stored in system memory 240). An operating system may be stored in any of a variety of locations and accessed, for example, according to instructions of the BIOS 268. As described herein, a device may include fewer or more features than shown in the system of FIG. 2.

Information handling device circuitry, as for example outlined in FIG. 1 or FIG. 2, may be used in devices such as a computer in a building such as a home (which is used throughout the remainder of the description as a non-limiting example of a building). The circuitry outlined in FIG. 1 and/or FIG. 2 may be included in a computing device of the home that accepts inputs, e.g., image data, voice or audio data, fingerprint data, and the like, and processes the inputs in order to identify a user, e.g., a home owner, using biometric techniques. Moreover, a computing device may be utilized to provide outputs, e.g., in response to a biometric identification of a home owner, or lack thereof, e.g., detection of a house guest. The output(s) may automate adjustment of various security settings, e.g., increasing or reducing access to various areas of the home, increasing or reducing accessibility to home features, etc., as further described herein.

Figure 3:
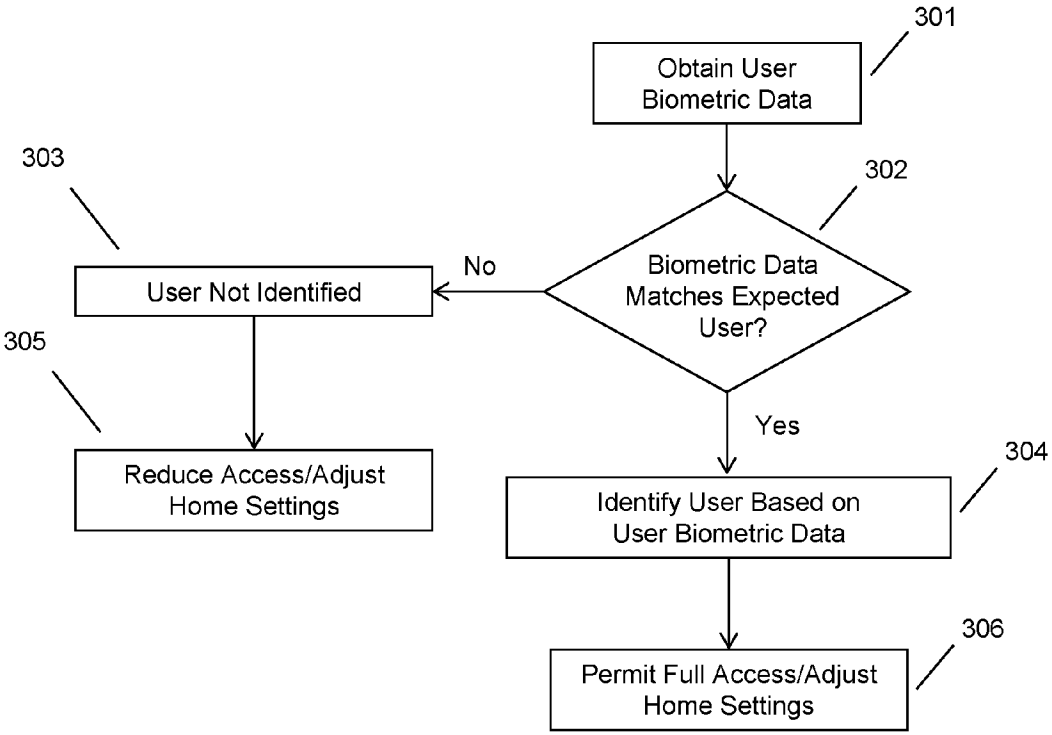
FIG. 3 illustrates an example method of using biometric identification for restricting access to a home.

Turning to FIG. 3, an embodiment obtains user biometric data, e.g., from sensors disposed in a home, at 301. The user biometric data may include facial recognition data, finger print data, and/or voice recognition data. User biometric data therefore may take a variety of forms. For example, the user biometric data obtained at 301 may include facial or voice recognition data, e.g., image and/or audio data that indicate that a particular user is within a particular area of a home or near or approaching a particular area of the home or item in the home (e.g., a particular room, a cabinet, an electronic device, etc.). As a further example, user biometric data may include fingerprint data collected from a fingerprint reader provided within the home, e.g., a fingerprint reader may be provided on an object such as a keypad located at the home's entrance, a touch screen of a media center or remote control device, etc.

As will be appreciated by those having skill in the art, various types of user biometric data may be combined to provide a biometric signature of a particular user. This biometric signature may be refined over time, e.g., by collecting user biometric data repeatedly and updating a user's biometric signature. In an embodiment, the user may enroll in a system, whether provided within the home or by a remote system, to provide biometric signature data and configure home security settings that are to be implemented automatically in response to biometric identification or lack thereof.

The user biometric data obtained at 301 is used to determine if the user biometric data matches expected user biometric data at 302. That is, the currently detected user biometric data obtained at 301 is compared to known user biometric data of a particular user in order to identify the particular user. The known user biometric data may be stored locally or accessed from a remote device. The known user biometric data may include a biometric signature or profile that has been generated based on historically detected user biometric data.

If the user is identified, as illustrated at 304, using the user biometric data obtained at 301, i.e., the currently detected user biometric data is similar or equivalent to known user biometric data, the user may be granted full access to the home, have continued access to the areas of the home, or have particular security settings (e.g., user-specific or customized settings) loaded, as illustrated at 306. Otherwise, i.e., if a user is not identified at 302, as illustrated at 303, the lack of user identification may lead to a requirement for reducing access to certain areas within the home, as illustrated at 305, which may be implemented by adjusting security settings to restrict access to areas within the home, for example by operating an electric motor to close a door, operating an electric lock to lock certain doors that have been close or to lock certain cabinets, etc. A centralized home computer system may be operatively connected to various movable elements (door actuators, electronic locking mechanisms, and the like) in order to coordinate security settings with detected biometric data of occupants of the house.

Further, certain devices within the home, e.g., home computers, entertainment centers, and the like may be secured by restricting access, e.g., requiring authentication to access the device/operate the device, or biometric data that is obtained at 301 may trigger the implementation of a guest mode, e.g., a mode having reduced functionality. For example, a guest mode or setting may be applied to device contained within the home, e.g., a media player or smart TV, if a particular user (e.g., the home's owner or authorized agent) is or is not identified at 302.

User biometric data may be used to identify a user at various times. For example, an embodiment may utilize user biometric data upon entry to the home, upon entry into a certain area of the home, upon approach to or proximate location near an object (e.g., cabinetry) and/or on an ongoing basis. By way of specific example, user biometric data may be obtained at 301, and a determination made at 302, repeatedly, e.g., according to a policy as an individual moves about the home. Thus, the individual may be initially granted access (with or without use of biometric identification) to a home generally, but thereafter may be required to supply correct user biometric data in order to access certain areas within the home. The obtaining of biometric data at 301 may be triggered by motion sensors such that biometric identification at 302, 303/304 occurs when an individual enters a certain area within the home. This permits the use of user biometric data to supplement other types of security mechanisms that might be applied, e.g., use of a physical or electronic keys, etc.

In an embodiment, biometric data is used on an ongoing basis to adjust security settings within the home. For example, in the case where multiple users occupy the same home, a user's biometric data may provide data for differential access to various parts or areas of the home. As an example, if a guest enters the home, one or more bedroom doors may be locked. However, if the home owner is also present, as the home owner approaches a locked bedroom door, a fresh biometric identification of the home owner in that area (e.g., approaching the bedroom door) may be used to automatically unlock that particular bedroom door. For example, image data indicating that the home owner is approaching the bedroom door may be utilized to unlock a particular bedroom door, whereas other security settings may be retained for other areas of the home.

In an embodiment, if a different or unidentified user is detected, as illustrated at 302, 303 of FIG. 3, an automated communication may be sent, e.g., to a predetermined contact, e.g., a primary owner's smart phone. This permits a particular user to be apprised of the fact that another user has been detected within the home, has been detected within a particular area of the home, or has been detected as being proximate to or near a given object within the home.

An embodiment therefore provides for automated home security setting adjustment using biometric identification techniques. In an embodiment, this permits a guest to access a home under conditions prescribed or configured by the home's owner.

As will be appreciated by one skilled in the art, various aspects may be embodied as a system, method or device program product. Accordingly, aspects may take the form of an entirely hardware embodiment or an embodiment including software that may all generally be referred to herein as a "circuit," "module" or "system." Furthermore, aspects may take the form of a device program product embodied in one or more device readable medium(s) having device readable program code embodied therewith.

It should be noted that the various functions described herein may be implemented using instructions stored on a device readable storage medium such as a non-signal storage device that are executed by a processor. A storage device may be, for example, an electronic, magnetic, optical, electromagnetic, infrared, or semiconductor system, apparatus, or device, or any suitable combination of the foregoing. More specific examples of a storage medium would include the following: a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a storage device is not a signal and "non-transitory" includes all media except signal media.

Program code embodied on a storage medium may be transmitted using any appropriate medium, including but not limited to wireless, wireline, optical fiber cable, RF, et cetera, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of connection or network, including a local area network (LAN) or a wide area network (WAN), or the connection may be made through other devices (for example, through the Internet using an Internet Service Provider), through wireless connections, e.g., near-field communication, or through a hard wire connection, such as over a USB connection.

Example embodiments are described herein with reference to the figures, which illustrate example methods, devices and program products according to various example embodiments. It will be understood that the actions and functionality may be implemented at least in part by program instructions. These program instructions may be provided to a processor of a device, a special purpose information handling device, or other programmable data processing device to produce a machine, such that the instructions, which execute via a processor of the device implement the functions/acts specified.

It is worth noting that while specific blocks are used in the figures, and a particular ordering of blocks has been illustrated, these are non-limiting examples. In certain contexts, two or more blocks may be combined, a block may be split into two or more blocks, or certain blocks may be re-ordered or re-organized as appropriate, as the explicit illustrated examples are used only for descriptive purposes and are not to be construed as limiting.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A method, comprising: obtaining, using a sensor, biometric data of a user; determining, using a processor, that the biometric data of the user does not match biometric data of a known user; implementing security settings for a building based upon the obtained biometric data; and securing, based on the biometric data of the user not matching a known user and the implemented security settings, at least one area within the building, wherein the securing comprises locking the at least one area of the building to restrict access.

2. The method of claim 1, wherein the area within the building is selected from the group consisting of a room, an entrance, and an object.

3. The method of claim 1, wherein the securing comprises implementing an added security measure.

4. The method of claim 3, wherein the added security measure requires authentication to remove the added security measure.

5. The method of claim 1, comprising providing an owner profile for the known user comprising a plurality of preferred security settings.

6. The method of claim 5, wherein the securing comprises implementing one or more of the plurality of preferred security settings.

7. The method of claim 1, comprising initiating a communication to the known user in response to the determining that the biometric data of the user does not match biometric data of a known user.

8. The method of claim 1, comprising removing a security measure applied to the area within a building based on additional biometric data.

9. The method of claim 8, wherein the removing is applied to a first area of the building while maintaining a security measure applied to a second area of the building.

10. A device, comprising: a biometric sensor; a processor operatively coupled to the biometric sensor; and a memory that stores instructions executable by the processor to: obtain biometric data of a user; determine that the biometric data of the user does not match biometric data of a known user; implement security settings for a building based upon the obtained biometric data; and secure, based on the biometric data of the user not matching a known user and the implemented security settings, at least one area within the building, wherein the instructions to secure the at least one area within the building comprise instructions to lock the area of the building to restrict access.

11. The device of claim 10, wherein the area within the building is selected from the group consisting of a room, an entrance, and an object.

12. The device of claim 10, wherein the processor executes instructions to secure an area within the building by implementing an added security measure.

13. The device of claim 12, wherein the added security measure requires authentication to remove the added security measure.

14. The device of claim 10, wherein the processor executes instructions to provide an owner profile for the known user comprising a plurality of preferred security settings.

15. The device of claim 14, wherein the processor executes instructions to secure an area within the building by implementing one or more of the plurality of preferred security settings.

16. The device of claim 10, wherein the processor executes instructions to initiate a communication to the known user in response to the determining that the biometric data of the user does not match biometric data of a known user.

17. The device of claim 10, wherein the processor executes instructions to remove a security measure applied to the area within a building based on additional biometric data.

18. A program product, comprising: a storage device that stores code, the code being executable by a processor and comprising: code that obtains, using a sensor, biometric data of a user; code that determines, using the processor, that the biometric data of the user does not match biometric data of a known user; code that implements security settings for a building based upon the obtained biometric data; and code that secures, based on the biometric data of the user not matching a known user and the implemented security settings, at least one area within the building, wherein the code that secures comprises code that locks the at least one area of the building to restrict access.

* * * * *